US005389163A

United States Patent [19]

Hachisuka

[11] Patent Number: 5,389,163

[45] Date of Patent: Feb. 14, 1995

[54] METHOD FOR PRODUCING A RUBBER-REINFORCED STEEL WIRE

[75] Inventor: Shunji Hachisuka, Ibaraki, Japan

[73] Assignee: Tokyo Rope Mfg. Co., Ltd., Tokyo, Japan

[21] Appl. No.: 236,696

[22] Filed: May 2, 1994

Related U.S. Application Data

[63] Continuation of Ser. No. 989,232, Dec. 11, 1992, abandoned.

[30] Foreign Application Priority Data

Dec. 16, 1991 [JP] Japan ..... 3-331920

[51] Int. Cl.[6] ..... C25D 5/50; C25D 7/06

[52] U.S. Cl. ..... 148/532; 148/537

[58] Field of Search ..... 428/610, 625, 677, 941; 148/532, 537, 534; 152/451, 565; 57/902

[56] References Cited

U.S. PATENT DOCUMENTS

| | | | |
|---|---|---|---|
| 2,939,207 | 6/1960 | Allen | 428/625 |
| 4,226,918 | 10/1980 | Friend | 152/451 |
| 4,704,337 | 11/1987 | Coppens et al. | 152/451 |
| 4,786,377 | 11/1988 | De Filippo et al. | 428/658 |
| 4,911,991 | 3/1990 | Van Ooij | 428/659 |
| 4,929,512 | 5/1990 | Nishimura et al. | 428/941 |

FOREIGN PATENT DOCUMENTS

| | | | |
|---|---|---|---|
| 0343254 | 11/1989 | European Pat. Off. . | |
| 2039580A | 8/1980 | United Kingdom | 152/451 |
| 2076320A | 12/1981 | United Kingdom . | |
| WO89/03901 | 5/1989 | WIPO . | |

OTHER PUBLICATIONS

"Application of XPS to the Study of Polymer–Metal Interface Phenomena", Applications of Surface Science 4 (1980), pp. 324–339, North–Holland Publishing Company.

*Primary Examiner*—John Zimmerman

*Attorney, Agent, or Firm*—Frishauf, Holtz, Goodman & Woodward

[57] ABSTRACT

A brass layer is formed on a steel wire, and an Ni layer is formed on the brass layer. Then, the steel wire is drawn through a die, and the brass layer and Ni layer are mixed into an alloy coating layer. In the coating layer, the closer to its surface the higher the Ni content. According to the method, a rubber-reinforcing steel wire can be produced which shows improved wet adhesive property to rubber, without degrading drawability.

5 Claims, No Drawings

METHOD FOR PRODUCING A RUBBER-REINFORCED STEEL WIRE

This application is a continuation of application Ser. No. 07/989,232, filed Dec. 11, 1992, now abandoned.

BACKGROUND OF THE INVENTION

1. Field of the Invention

This invention relates to a rubber-reinforcing steel wire for use in a steel radial tire, a high-pressure hose, or a conveyer belt, and a method for manufacturing the same.

2. Description of the Related Art

In a steel wire to be used as a rubber-reinforcing member in a steel radial tire, a high-pressure hose, or a conveyer belt, the adhesive properties between the wire and vulcanized rubber and the persistence of the properties are important factors. A conventional practical rubber-reinforcing steel wire generally has a coating layer made of brass for enhancing the adhesive properties between the wire and rubber. The brass layer can be formed by alloy plating using a cyanide bath. In this method, however, pollution arising from use of cyanide must be avoided, and it is relatively difficult to control Cu content of the brass. Thus, diffusion plating, in which a thermodiffusion treatment is performed after Cu and Zn are plated in order, has become a technique used widely. As heating methods, there is employed electric heating, high-frequency heating, heating using a fluidized bed furnace, etc.

During vulcanization, Cu contained in brass exhibits a high reactivity against sulfur contained in rubber, whereas Zn properly reduces Cu reactivity. As a result, a proper quantity of sulfide can be formed at the interface between the coating layer of the wire and rubber. It is believed that good primary adhesive property to rubber is obtained by such a mechanism. However, a rubber-reinforcing steel wire having a brass-plating layer is disadvantageous in that the adhesive property to rubber under high humidity conditions i.e. wet adhesive property is degraded. To improve this property, it is considered preferable to prevent excessive generation of sulfide at the interface between the coating layer and rubber, and to minimize the Cu content of the brass-plating layer.

Further, to enhance the strength of the steel wire and the rubber reinforcing effect, the wire is subjected to cold working, especially drawing using a die. The drawing is performed under very severe conditions. Therefore, if the brass plating layer has low deformability, a great amount of friction heat will be generated, the wire will have high resistance against drawing, the life of the die will be reduced, or the wire may even be broken during drawing.

As regards the brass plating layer, the a phase crystal has a higher ductility and malleability than the $\beta$ phase crystal. This is because the $\beta$ phase has a body-centered cubic lattice, whereas the a phase has a face-centered cubic lattice and hence has lots of slip planes. To enhance the drawability, the ratio of the $\beta$ phase to the a phase in the brass-plating layer is preferably low. If diffusion plating is used, the crystal phase can be influenced by the heating conditions. It is known that the higher the heating temperature and the longer the heating time, the more partial diffusion is likely to occur and the lower the ratio of the $\beta$ phase. In view of this, optimal conditions are selected.

However, if Cu content of the brass plating layer is reduced so as to improve the wet adhesive property, it is known that the ratio of the $\beta$ phase increases. Where the Cu content of brass is relatively low, e.g. lower than 62%, it is difficult to perform drawing. From the industrial point of view, the lower limit of the Cu content of brass is about 63%. In summary, therefore, it is very difficult to obtain both good wet adhesive property and good drawability.

With the aim of overcoming the above drawback, a technique has been proposed for improving the wet adhesive property by forming a coating layer made of an alloy consisting of brass and a third element (X). As the third element (X), there is used Ni (disclosed in Published Unexamined Japanese Patent Application No. 55-105548), Co (Published Examined Japanese Patent Application No. 1-37411), Fe (Published Examined Japanese Patent Application No. 2-39599), or the like. In these disclosures, a coating layer is formed by laminating Cu, X, and Zn plating layers in this order, and is then subjected to a thermodiffusion treatment. The reason the X plating layer is interposed between the Cu and Zn plating layers is that it is difficult to tightly laminate the Cu plating layer on the Zn plating layer. However, when the third element (X) has a high melting point, the X plating layer functions as barrier layer which hinders partial diffusion of Cu and Zn, thereby increasing in the ratio of the $\beta$ phase and degrading the drawability of the steel wire.

A method of performing a thermodiffusion treatment after laminating Cu, Zn, and X plating layers in this order also has been proposed. In this structure, the plating layer of the third element does not hinder partial diffusion of Cu and zn. However, a Zn-X phase is created, and the drawability of the steel wire will be significantly degraded depending on the ductility of this phase. Moreover, a method of performing a thermodiffusion treatment after laminating X, Cu, and Zn plating layers in this order has been proposed. In this structure, the plating layer of the third element merely functions as an underlying layer, with the result that a desired alloy of the third element and brass plating cannot be obtained, therefore, a satisfactory effect of the third element cannot be realized.

Yet another, a method of alloy plating a steel wire with Cu-Ni, where Ni is used as a third element, plating it with Zn and then performing a thermodiffusion treatment, has been proposed. In this method, it is necessary, but quite difficult, to control the Ni content of the alloy in accordance with the Cu-Ni plating conditions. Further, the $\beta$ phase is likely to grow under the influence of Ni having a high melting point. Moreover, the Ni will be diluted as a result of partial diffusion with Cu-Zn, and hence the addition amount of Ni must be increased so as to improve the wet adhesive property.

Published Examined Japanese Patent Application No. 52-14778 discloses a method of alloy plating a steel wire with Cu-Zn (brass), plating it with Sn used as a third element and then drawing it. However, the steel wire obtained by this method is advantageous only in enhancing the adhesive property of the wire to rubber containing moisture during vulcanization, and also in reducing the possibility of breakage of a steel cord due to heat or wear caused during use of a tire. Accordingly, an improved secondary wet adhesive property is not realized.

SUMMARY OF THE INVENTION

It is the object of the invention to provide a rubber-reinforcing steel wire whose adhesive properties to rubber are improved without degrading its drawability, and a method for manufacturing the steel wire.

According to a first aspect of the invention, there is provided a rubber-reinforcing steel wire comprising a steel wire, and a coating layer formed on the steel wire and made of an alloy consisting of Cu, Zn, and Ni, whose Ni content is higher at the surface and becomes lower toward the deeper region.

According to another aspect of the invention, there is provided a method for manufacturing the rubber-reinforcing steel wire, comprising the steps of: forming a brass layer on the steel wire; forming an Ni layer on the brass layer; and drawing the steel wire through a die to form a coating layer made by alloying the Ni layer with the brass layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENT

In the invention, it is preferable from a viewpoint of strength to use a high carbon steel containing 0.70% or more carbon as a wire material.

As methods for coating a wire with a brass layer herein, there is employed a diffusion plating, i.e., a method of forming on a wire a Cu plating layer and a Zn plating layer in this order and then subjecting the wire to a thermodiffusion treatment, and cyanide plating using a cyanide bath. However, in the cyanide plating, it is necessary to avoid pollution due to cyanide, and it is difficult to control the Cu content of the brass layer. Therefore, the diffusion plating is preferable. Further, the Cu content of the brass layer is preferably ranging from 63 to 67%. The brass layer of such a composition consists of only the a phase with a face-centered cubic lattice having a high ductility and malleability, and does not contain the $\beta$ phase with a body-centered cubic lattice.

A usual plating method is employed to form an Ni layer on the brass layer in the invention. The Ni layer preferably has a thickness ranging from 0.04 to 0.15 $\mu$m. The amount of Ni used in the invention is very smaller than in the conventional case. In addition, Ni has a high ductility and malleability since it has a face-centered cubic lattice.

Thus, in a state in which the Ni layer is formed on the brass layer, the drawability of the wire are as good as those of a wire having a brass layer only.

Then, the wire plated with the brass layer and Ni layer is subjected to drawing through a die. A coating layer is formed on the resultant wire, in which the two plating layers are mechanically mixed into an alloy. At this time, though the contents of brass and Ni are horizontally uniform, the closer to the surface in a thickness direction of the coating layer, the higher the Ni content. This seems because mechanical alloying of Ni has occurred partially. It is preferable that the diameter reduction rate by drawing is not less than 90% and not more than 98%. The tendency is found that the higher the degree of the drawing, the more uniform the composition in the thickness direction. If the Ni plating layer is thick, the two plating layers will not be satisfactorily mixed, resulting in stripe-like distribution of Ni.

In the invention, since an extremely small amount of Ni is contained in the brass layer, the crystal phase of brass is not influenced by Ni. Further, it is considered that Ni serves to restrain the reaction between Cu and sulfur. Accordingly, in the wire of the invention, a proper quantity of sulfide is generated at the interface between the coating layer and rubber also in humidity conditions, so that the wet adhesive property is improved.

Note that if Co is used as a third element in the method of the invention, the Co plating layer may be removed during the drawing process, since Co has a close-packed hexagonal lattice with a low ductility.

EXAMPLES

The examples of the invention will be described.

Examples 1–5

A high carbon steel wire having a diameter of 1.70 mm and containing 0.82% C was used. A Cu plating layer was formed in a copper pyrophosphate bath, and a Zn plating layer was formed in a zinc sulfate bath. Then, the Cu and Zn plating layers were alloyed into a brass layer by a thermodiffusion treatment in a fluidized bed furnace. An oxide layer was removed by etching in a diluted sulfuric acid. As is shown in Table 1, the brass layer contained 65% Cu, its coating amount was 4.0 g/kg wire, and no $\beta$ phase was observed in the brass layer.

Subsequently, an Ni plating layer was formed in nickel sulfate bath. As is shown in Table 1, the thicknesses of the Ni plating layers of Examples 1–5 ranged from 0.04 to 0.20 $\mu$m.

The resultant steel wire was subjected to drawing using a cemented carbide die, where a wire with a diameter of 0.30 mm was produced. During drawing, brass and Ni were made mechanically alloyed to form a coating layer.

Example 6

A steel wire was produced in the same manner as in Examples 1–5, except that a brass layer was formed by alloy plating.

Comparative Examples 1 and 2

As in Examples 1–5, Cu and Zn plating layers were laminated on the wire in this order, and then subjected to a thermodiffusion treatment, thereby forming a coating layer made of brass. Comparative Example 1 and 2 differ from each other in the Cu content of brass. The resultant wires were subjected to drawing as in Examples 1–5.

Comparative Example 3

Cu, Zn, and Ni plating layers were laminated on the wire in this order, and then subjected to a thermodiffusion treatment, thereby forming a coating layer made of an alloy of Cu, Zn, and Ni. The resultant wire was subjected to drawing as in the above examples.

Comparative Example 4

Cu, Ni, and Zn plating layers were laminated on the wire in this order, and then subjected to a thermodiffusion treatment, thereby forming a coating layer made of an alloy of Cu, Ni, and Zn. The resultant wire was subjected to drawing as in the above examples.

Comparative Example 5

Ni, Cu, and Zn plating layers were laminated on the wire in this order, and then subjected to a thermodiffusion treatment, thereby forming a coating layer made of an alloy of Ni, Cu, and Zn. The resultant wire was subjected to drawing as in the above examples.

Table 1 shows the composition of each coating layer, the ratio of the $\beta$ phase in each coating layer, etc.

Moreover, a steel cord was made by stranding two steel wires according to each of Examples 1–6 and Comparative Examples 1–5. Then, each resultant steel cord and an industrial rubber compound was vulcanized for 30 minutes at 150° C. to produce a cord-rubber composite.

The drawability of each steel wire was estimated from the amount normally drawn per die. The drawability is represented by the relative value to that of Comparative Example 1 set to 100. Further, a primary adhesive property and a secondary wet adhesive property were estimated in each cord-rubber composite on the basis of ASTM-2229-73. As regards the primary adhesive property, the pull-out force required for pulling out each steel cord embedded in rubber by 12.7 mm and the ratio of an adhesion area of rubber on the cord were measured. As regards the secondary adhesive property, the pull-out force and the ratio of the adhesion area of rubber were measured in the same manner as above with respect to the sample having exposed to steam at 120° C. for 12 hours after the primary vulcanization. The results are shown in Table 2.

TABLE 1

| | Structure of Coating layer | Composition Cu % | Zn % | Ni % | $\beta$ Phase % | Coating Amount Br g/kg | Ni μm |
|---|---|---|---|---|---|---|---|
| Example 1 | Br—Ni | 65 | 35 | — | 0 | 4 | 0.04 |
| Example 2 | Br—Ni | 65 | 35 | — | 0 | 4 | 0.08 |
| Example 3 | Br—Ni | 65 | 35 | — | 0 | 4 | 0.11 |
| Example 4 | Br—Ni | 65 | 35 | — | 0 | 4 | 0.15 |
| Example 5 | Br—Ni | 65 | 35 | — | 0 | 4 | 0.20 |
| Example 6 | Br—Ni | 65 | 35 | — | 0 | 4 | 0.15 |
| Comparative Example 1 | Cu—Zn | 65 | 35 | — | 0 | 4 | — |
| Comparative Example 2 | Cu—Zn | 61 | 39 | — | 30 | 4 | — |
| Comparative Example 3 | Cu—Zn—Ni | 59 | 32 | 9 | 10 | 4.4 | — |
| Comparative Example 4 | Cu—Ni—Zn | 59 | 32 | 9 | 30 | 4.4 | — |
| Comparative Example | Ni—Cu—Zn | 59 | 32 | 9 | 0 | 4.4 | — |

TABLE 1-continued

| | Structure of Coating layer | Composition Cu % | Zn % | Ni % | $\beta$ Phase % | Coating Amount Br g/kg | Ni μm |
|---|---|---|---|---|---|---|---|
| 5 | | | | | | | |

Examples 1–5: The brass layer (Br) was formed by laminating a Cu plating layer and a Zn plating layer and the subjecting to a thermodiffusion treatment.
Example 6: The brass layer (Br) was formed by alloy plating.
Comparative Examples 1–5: The coating layer was formed by laminating respective plating layers and then subjecting to a thermodiffusion treatment.

TABLE 2

| | Drawability | Primary adhesive property: Pull-out Force kgf | Rate of Adhesion Area of Rubber % | Secondary wet Adhesive Property: Pull-out Force kgf | Rate of Adhesive Area of Rubber % |
|---|---|---|---|---|---|
| Example 1 | 100 | 43 | 100 | 35 | 90 |
| Example 2 | 100 | 43 | 100 | 36 | 92 |
| Example 3 | 100 | 42 | 100 | 38 | 94 |
| Example 4 | 95 | 43 | 100 | 40 | 95 |
| Example 5 | 90 | 41 | 90 | 40 | 95 |
| Example 6 | 95 | 43 | 100 | 40 | 95 |
| Comparative Example 1 | 100 | 43 | 100 | 30 | 70 |
| Comparative Example 2 | 70 | 42 | 100 | 34 | 90 |
| Comparative Example 3 | 90 | 42 | 100 | 39 | 95 |
| Comparative Example 4 | 70 | 42 | 100 | 35 | 90 |
| Comparative Example 5 | 100 | 42 | 100 | 30 | 70 |

As is evident from Tables 1 and 2, Comparative Example 1 has poor wet adhesive property. Comparative Example 2 has poor drawability since the ratio of the $\beta$ phase is high due to a low Cu content of brass. The drawability is not improved in a case where Cu, Zn and Ni, or Cu, Ni and Zn plating layers were laminated and then the thermodiffusion treatment was performed as in Comparative Examples 3 or 4. Further, the wet adhesive property is not improved in a case where Ni, Cu and Zn plating layers were laminated and then the thermodiffusion treatment was performed as in Comparative Example 5.

On the other hand, in Examples 1–6, the $\beta$ phase is not grown, and hence the drawability is not degraded, while the wet adhesive property is improved. However, when the Ni plating layer is as thick as 0.2 μm as in Example 5, a satisfactory primary adhesive property cannot be obtained.

In summary, the invention can provide a rubber-reinforcing steel wire which shows improved wet adhesive property to rubber, without degrading its drawability.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method for manufacturing a rubber-reinforcing steel wire, comprising the steps of:

providing a steel wire;

forming a brass layer on the steel wire, the brass layer having a Cu content within a range from 63 to 67%;

forming a Ni layer on the brass layer, the Ni layer having a thickness within a range from 0.06 to 0.15 μm; and drawing the steel wire, having the brass and Ni layers thereon, through a die to form a coating layer made by alloying the Ni layer and the brass layer.

2. The method according to claim 1, wherein the steel wire is made of a high carbon steel containing 0.7% or more carbon.

3. The method according to claim 1, wherein the brass layer is formed by laminating a Cu plating layer and a Zn plating layer on the steel wire in this order, and then subjecting the Cu and Zn plating layers to a thermodiffusion treatment.

4. The method according to claim 1, wherein a diameter reduction rate of the steel wire in the drawing step falls within a range of from 90% to 98%.

5. The method according to claim 1, wherein the Ni layer has a thickness of 0.08 to 0.15 μm.

* * * * *